United States Patent [19]

Weber

[11] 4,047,506

[45] Sept. 13, 1977

[54] GAS HEATED STEAM GENERATOR

[75] Inventor: Max Weber, Wiesendangen, Switzerland

[73] Assignee: Sulzer Brothers Limited, Winterthur, Switzerland

[21] Appl. No.: 637,399

[22] Filed: Dec. 3, 1975

[30] Foreign Application Priority Data

Dec. 6, 1974 Switzerland ..... 16222/74

[51] Int. Cl.[2] ..... F22B 1/18

[52] U.S. Cl. ..... 122/32; 122/483

[58] Field of Search ..... 122/32, 33, 34, 483

[56] References Cited

U.S. PATENT DOCUMENTS 3,279,439 10/1966 Ammon ..... 122/483

3,308,878 3/1967 Durst et al. ..... 122/32

3,882,933 5/1975 Kube ..... 122/32

*Primary Examiner*—Kenneth W. Sprague

*Attorney, Agent, or Firm*—Kenyon & Kenyon, Reilly, Carr & Chapin

[57] ABSTRACT

The steam generator is made of two assembly parts which can be transported separately and installed in place one above the other. The lower part contains a reheater made up of a group of U-shaped tubes. The two leg portions of this tube group are disposed within a casing which has two oppositely disposed inlet openings for the heated gas flow. Various partitions and covers are also provided to direct, the heated air in two counterflows over the leg portions and, thence, out of the lower generator part over the superheater and evaporator in the upper part of the generator.

14 Claims, 6 Drawing Figures

GAS HEATED STEAM GENERATOR

This invention relates to a gas heated steam generator and particularly to a steam generator for a nuclear reactor plant.

Heretofore, it has been known to construct a steam generator, for example for a nuclear reactor plant, which contains an evaporator, superheater and reheater within a cylindrical chamber. Usually the chamber has an opening for a supply of hot gas as well as supply lines for a medium to be evaporated and exhaust lines for live steam at one end. In addition, lines have also been provided for supplying and exhausting the steam to be heated in the reheater.

A steam generator of this kind is known from German published patent application DOS No. 2,249,811. In this case, all the heating surfaces of the steam generator consist of helical tubes, and the individual heating surfaces are disposed successively in the hot-gas flow in the cylindrical chamber. However, the tube arrangement in such a steam generator is quite complicated, particularly the arrangement of the tubes leading to the reheater. Moreover, the steam generator is difficult to transport because the generator cannot easily be subdivided into transportable units. In particular, the tubes which supply and exhaust the high-pressure working medium and which surround the reheater cannot be easily subdivided.

Accordingly, it is an object of the invention to provide a steam generator of simple construction which can be divided into at least two parts for transportation purposes.

It is another object of the invention to provide a steam generator which is of relatively simple construction.

It is another object of the invention to provide a stream generator which has a relatively uncomplicated tube arrangement for the heating surfaces of the generator.

Briefly, the invention provides a steam generator comprising two parts which are separable from each other for transporting from a workshop to an installation site. One part contains aa group of U-shaped tubes to define a reheater of the generator, a casing which surrounds the group of U-shaped tubes and a tubular connector on the casing. The casing is further provided with a pair of oppositely disposed openings to receive heated gas when the generator is in operation so that the gas may flow over the U-shaped tubes. The tubular connector also defines an outlet opening for the heated gas within the casing. The other part of the steam generator is removably mounted on the first part and contains an evaporator and a superheater as well as a tubular connector. This latter connector is mounted coaxially with the connector on the first generator part to permit the heated gas to flow over the superheater and evaporator.

The above two parts of the steam generator when in place are housed within a means which defines a cylindrical chamber having a bottom and an inlet for a flow of heated gas.

The group of U-shaped tubes forming the reheater define a pair of vertically disposed spaced apart leg portions which are mounted on the bottom of the generator to receive and conduct steam from outside the generator chamber from one leg portion to the other leg portion. The casing surrounding these tubes has means for conducting the heating gas from the two entry openings in two counterflows through each of the two legs of the group of U-shaped tubes and thence to the other heating surfaces of the steam generator after being cooled by the U-shaped tubes.

By making the reheater as a group of U-shaped tubes, a simple arrangement of the tubes results both for the reheater itself as well as for the supply to and exhaust from the high-pressure heating surfaces, i.e., the evaporator and superheater. Further, because of the simpler arrangement of the tubes with the steam generator, the cost of material is considerably less.

These and other objects and advantages of the invention will become more apparent from the following detailed description and appended claims taken in conjunction with the accompanying drawings in which:

Figure 1:
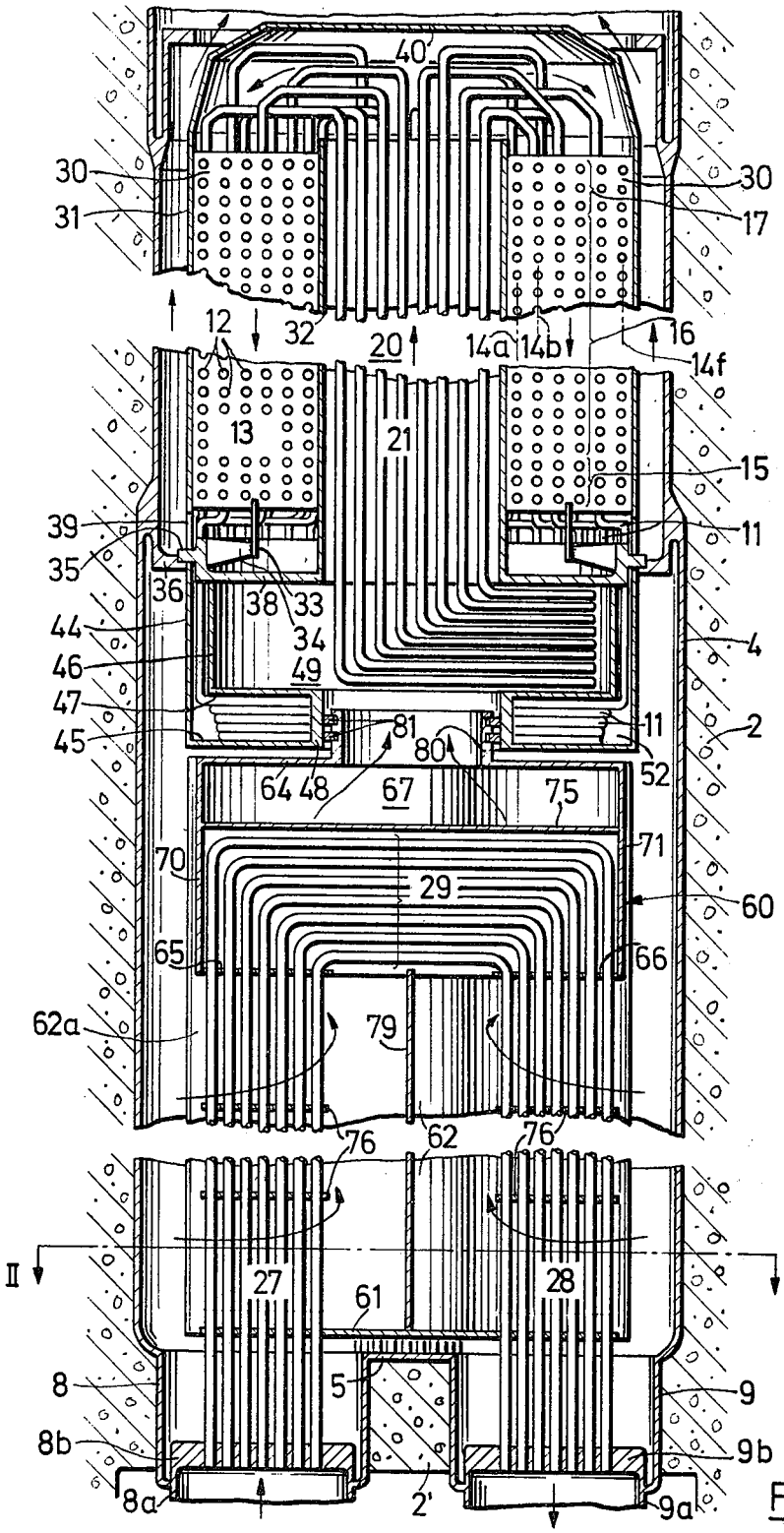
FIG. 1 illustrates a vertical sectional view taken on line I—I of FIG. 2 of a steam generator according to the invention.

Referring to FIG. 1, the steam generator is housed in a shielding concrete enclosure 2, which defines a circular-cylindrical chamber and has a lateral supply-opening 3 (FIG. 3) for a heating-gas, e.g., helium or carbon dioxide, coming from a nuclear reactor (not shown). An exhaust opening (not shown) for the cooled heating gas is located at the upper end of the concrete enclosure 2. The concrete enclosure 2 is lined with a steel lining 4 and has an intermediate concrete floor 2' at the lower end of the steel lining 4 forming a bottom. This floor 2' is provided with four passageways for tubes which conduct a working medium. The passageways are likewise each provided with a tubular steel lining 6, 7, 8, 9 (FIG. 3) and connectors *6a, 7a, 8a, 9a* are secured to the steel linings 6–9 as well as lines (not shown) for supplying a working medium. The upper end of each connector *6a* to *9a* is welded to a tube-bottom *6b, 7b, 8b, 9b,* respectively. The upper side of the concrete floor 2' is provided with a steel covering 5, which is connected with the tubular lining 6 to 9 in gas-tight manner.

Figure 3:
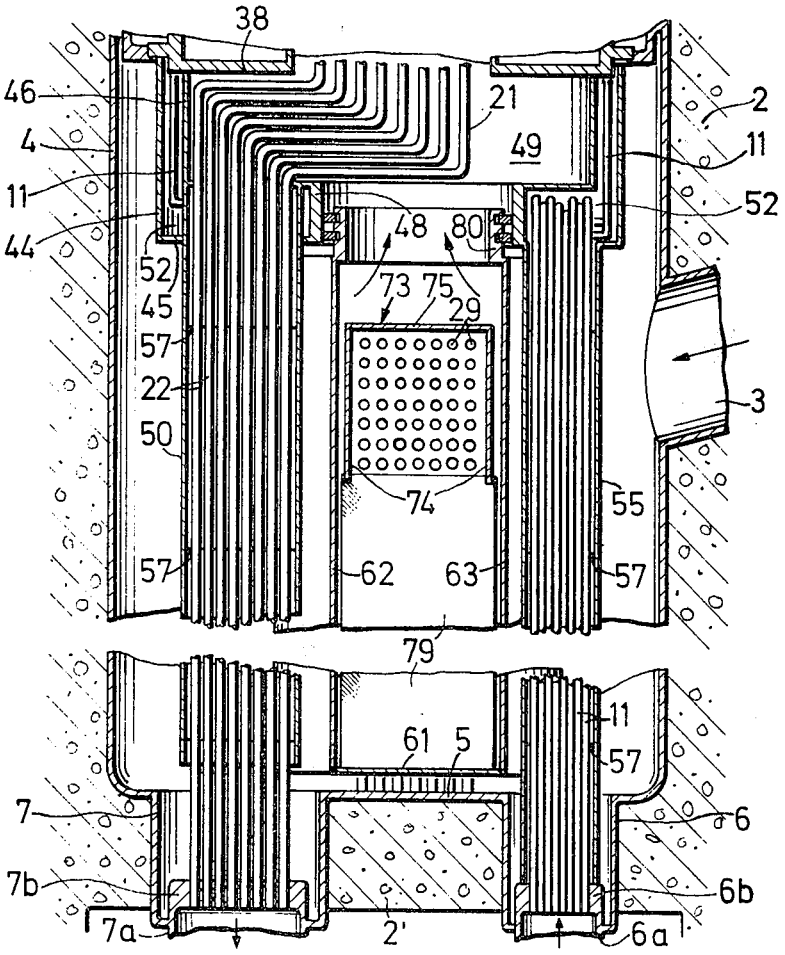
FIG. 3 illustrates an axial section taken on line III—III of FIG. 2.

As shown in FIG. 3, a group of tubes 11 rises from the tube-bottom *6b* to act as a means to supply feed-water to the steam generator and conduct the feed water to the lower end of a heat-transmitter 13 consisting of helical tubes 12, and situated in the upper part of the space delimited by the concrete enclosure 2. The manner in which the tubes 11 are arranged is explained in more detail in the following. The tubes 12 of the heat-transmitter 13 run, with similar ascent in six round-cylinder surfaces *14a* to *14f*. The lowermost part of the heat-transmitter 13 forms a feed-water preheater 15; while the uppermost part forms a preliminary superheater 17. The intermediate part 16 of the heat-transmitter 13 forms an evaporator and occupies the major space of the heat-transmitter 13. At the upper end of the heat-transmitter 13, the tubes 12 run to a central shaft 20, defined by a sheet-metal cylinder 32. The tubes 12 extend downwardly through the shaft 20 and form a therminal superheater 21. From the superheater 21, the tubes communicate as explained below in greater detail, with the tube-bottom 7b in leakproof manner.

A reheater is mounted within the chamber and is formed by a group of U-shaped tubes 25. Both the inflow and outflow ends of the tubes are mounted in the bottom of the chamber in the tube bottoms 8b, 9b respectively. The tubes 25 form a pair of vertically disposed spaced apart leg portions 27, 28 which are connected by the remaining horizontal portions 29.

The heat-transmitter 13 is carried by a supporting structure formed of four radial perforated plates 30 with the helical tubes 12 passing through the holes in the plates 30 as is known. The perforated plates 30 are disposed between the sheet-metal cylinder 32 enclosing the shaft 20 and a coaxial sheet-metal cylinder 31 surrounding the heat-transmitter 13. The perforated plates are supported on vertical leaf-springs 33, disposed on arms 34 extending radially inward. The arms 34 run from a ring 35 of T cross-section, whose web lies in a horizontal plane. The ring 35 is supported on a flange 36, extending inwardly from the lining 4, and forms a gas-tight connection with this flange. A bottom 38 in the form of an annular disk is secured at the lower edge of the ring 35 and is connected at the inner periphery to the sheet-metal cylinder 32. The sheet-metal cylinder 31 is supported by narrow webs on the ring 35, in order to form passageways 39 between the webs for the cooled-down heating gas. Two conical sections are connected in sequence at the upper end of the sheet-metal cylinder 31 of which the upper section is welded to a horizontal cover 40. The tubular sections of the terminal superheater 21 that extend through the shaft 20 are disposed grate-fashion, are spaced apart, and are held by supporting rods (not shown) fastened to the sheet-metal cylinder 32.

A sheet-metal cylinder 44 extends downwardly from the ring 35 in alignment with the cylinder 31 and is connected in gas-tight manner to the ring 35. This cylinder 44 merges at the lower end into an annular disk 45. A cylindrical wall 46 is welded to the bottom 38 and is connected at the lower end in gas-tight manner with the outer periphery of an annular disk 47. The inner periphery of this disk 47 and the inner circumference of the annular disk 45 are connected together in gas-tight manner over a tubular connector 48.

A circular-cylinder space 49 is defined at the top by the plane of the annular-disk-shaped bottom 38, at the bottom by the plane of the annular disk 47, and on the periphery by the cylindrical wall 46. The lower ends of the tubes forming the terminal superheater 21 are bent horizontally outward in this space 49 and connect with vertical tubes 22 which end in the tube-bottom 7b (FIG. 3). The tube sections running horizontally in the space 49 thus form expansion branches. The vertical tubes 22 form a group and are surrounded by a protective tube 50 that ends shortly above the intermediate bottom 2', and prevents the tubes 22 from having the heating gas flow round them. The upper section of the protective tube 50 passes through an annular space 52 and joins the annular disk 47. The annular space 52 is defined at the top by the annular disk 47, at the bottom by the annular disk 45, at the outside by the sheet-metal cylinder 44 and at the inside by the tubular connector 48.

The tubes 11 which supply the feed-water also run in a protective tube 55 which terminates in the space 52. These tubes 11 are bent horizontally and are distributed uniformly round the annular space 52. Here too, the horizontal tube sections form expansion branches. The tubes 11 are bent vertically upward at the outer periphery of the annular space 52 and extend through an annular gap formed between the sheet-metal cylinder 44 and the cylindrical wall 46, as well as through axial openings in the ring 35. The tubes 11 are bent horizontally inward close below the heat-transmitter 13 and are then distributed among the six tubular cylinders 14a to 14f (FIG. 1). Inside the protective tubes 50 and 55, the tubes 22 and 11 respectively are held in position relatively to one another by horizontal tube-plates 57 (FIG. 3). These tube-plates 57 throttle the gas-flows along the tubes to only a negligible degree.

Figure 2:
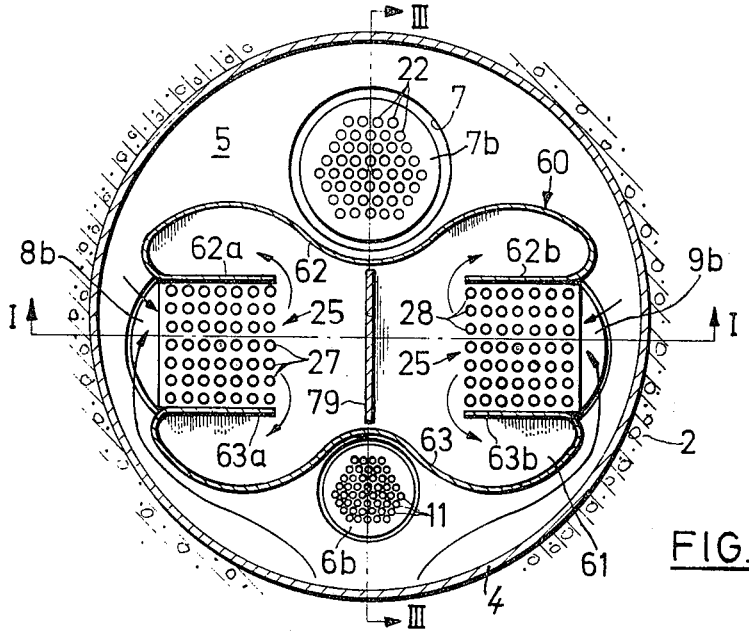
FIG. 2 illustrates a view taken on line II—II of FIG. 1.

The group 25 of U-shaped tubes is surrounded by a sheet-metal casing 60, of a form that divides the heating gas, coming from the reactor, into two parallel flows, each of which flows transversely through one leg portion 27, 28 of the group of U-shaped tubes. The sheet-metal casing 60 consists essentially of a horizontal bottom sheet 61, two vertical undulated wall-sheets 62, 63 (FIG. 2) and of a horizontal cover-sheet 64. The two vertical wall-sheets 62 and 63 each form a part of a cylindrical surface. The vertical generator of this cylindrical surface follows a curve that runs first in a horizontal plane convexly, then concavely, and finally convexly again (FIG. 2). The two undulated walls 62, 63 are welded at their bottom and top to the bottom-sheet 61 and cover-sheet 64. The convex ends of the two walls 62 and 63 are connected to plane walls 62a and 62b, and 63a and 63b respectively, which extend into the interior of the casing 60, from the bottom sheet 61 to close below the horizontal tube portion 29. The upper ends of the walls 62a, 63a are connected together by a perforated sheet 65 which extends parallel to the bottom-plate 61. Similarly, the walls 62b, 63b are connected together by a perforated sheet 66. The ascending leg portions 27 of the tubes 25 extend through the perforated sheet 65 while the descending leg portion 28 extends through the sheet 66. Two oppositely disposed rectangular inlet openings defined by the bottom sheet 61, the perforated sheet 65, 66 respectively, and the plane walls 62a and 63a, and 62b and 63b, are situated transversely of the lateral supply opening 3 in the concrete case for the heating gas coming from the reactor (not shown). the two rectangular heating-gas inlets are repeatedly divided vertically by horizontal perforated plates 76 (FIG. 1) whereby the legs of the U-shaped tubes extend through holes in these plates.

A partition 79 is provided within the casing 60 and extends from the bottom sheet 61 to close below the horizontal tube-section 29. This partition 79 is situated approximately in the middle between the two heating-gas inlet openings of the casing 60.

A sheet-metal cover 73 of U-shaped profile (FIG. 3) is mounted within the upper part of the casing 60 and has two branches 74 which extend vertically over the region of the horizontal tube-section 29, and are connected in alignment to the plane walls 62a and 62b and 63a and 63b respectively. A web-sheet 75 of the cover 73 extends above the horizontal tube-section 29 over the entire width of the group 25 of U-shaped tubes. The two end faces of the cover 73 are closed by a sheet-metal wall 70 and 71 (FIG. 1) respectively, which extend vertically to the cover-plate 64 to which they are welded as well as laterally to the undulating walls 62, 63. An opening is provided in the center of the cover-plate 64 which is defined by a tubular connector 80, disposed over piston-rings 81 in the tubular connector 48.

During operation, feed water is supplied to the steam generator and is distributed in the connectors 6a to the tubes 11, and then arrive in the tubes 12 of the heat-transmitter 13. The feed-water is preheated in the preheater 15 and then vaporized in the evaporator 16. The steam thus produced is slightly superheated in the preliminary superheater 17, and then flows, for further superheating, through the tubes of the terminal superheater 21 into the shaft 20. The superheated steam then passes via the tubes 22 and the connectors 7a to a high-pressure turbine (not shown) outside the generator.

The partly expanded steam in the high-pressure turbine (not shown) then flows back to the reheater in the steam generator, and is distributed over the connectors **8*a* to the ascending leg portions 27 of the group of U-shaped tubes 25. After picking up heat in these leg portions, the partly-expanded steam flows over the horizontal tube-sections 29 to the descending leg portions 28 to receive additional heat. From the connectors 9*a*,** the reheated steam then passes to a medium-pressure turbine (not shown).

The heating gas coming from the reactor (not shown) passes through the lateral supply-opening 3 into the lower part of the steam generator. By means of the sheet-metal casing 60, the flow of heating gas is divided into two flows directed in counterflow to one another. The gas then flows over the leg portions 27, 28 of the group of U-shaped tubes 25, to flow round them. In the interior of the casing 60, the two flows of heating gas are diverted upwardly by the partition 79 and outwardly by the cover 73 and then flow, through the spaces formed essentially by the four convex parts of the walls 62 and 63 and the plane walls **62*a*, 62*b*, 63*a*, 63*b* and 74 past the horizontal tube-section 29, and into the space 67 above the cover 73. From this space 67, the heating gas then flows through the connectors 80 into the vertical shaft 20, in which a further delivery of heat to the tubes of the terminal superheater 21 occurs. The heating gas is then deflected at the cover 40 and flows downward through the annular space between the sheet-metal cylinders 31 and 32 so that the residual heat of the heating gas is delivered to the working medium flowing in the tubes 12. The cooled heating gas finally passes through the openings 39 into the annular space between the sheet-metal cylinder 31 and the steel lining 4** and ascends to leave the steam generator. A blower may be disposed directly above the steam generator to convey the heating gas back to the nuclear reactor (not shown).

Figure 4:
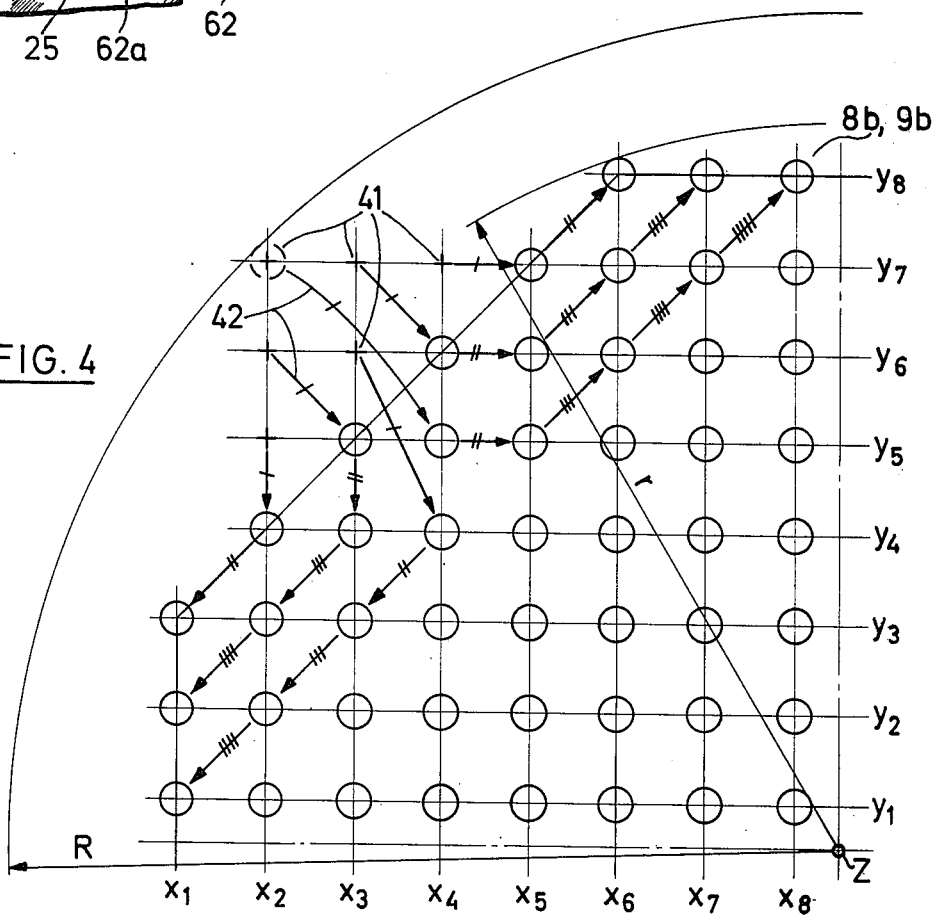
FIG. 4 illustrates a part of the tube bottom with a network of bores.

As compared with the prior art, the described steam generator is characterized by simple arrangement of the tubes. The group of U-shaped tubes 25 has a tube arrangement which can be circumscribed by a square in the region between the bottom sheet 61 and the perforated sheets 65, 66 (FIG. 1). Because the leg portions 27, 28 run straight, this same arrangement of tubes appears also in the tube-bottoms **8*b* and 9*b*. In order to better utilize the area through which the tubes pass, the tubes may be arranged as shown in FIG. 4. FIG. 4 shows a quadrant of one of the two tube-bottoms 8*b* and 9*b*,** in which a coordinate system $x_1 - x_8/y_1 - y_8$, the bores through which the tubes pass are shown by circles. The network of these bores is circumscribed by an octagon. The circle circumscribing the network of the bores has a radius $r$ having a centerpoint coinciding with the center Z of the tube-bottom.

Above the tube-bottom, i.e., at the height of the bottom sheet 61, the bores 27 and 28 are arranged in a square field, which in FIG. 4 corresponds to a region extending from $x_2$ to $x_8$ and $y_1$ to $y_7$. As shown in FIG. 4, six tubes, designated 41, lie outside the octagon circumscribing the network. When connecting the tube ends with the tube-bottom, the six tubes 41 are bent elastically or plastically and their ends are introduced into the bores at the points of the single-line arrows 42. To do this, secondary, tertiary, quartery and quintary displacements of the tube-ends are required. These are shown by arrows struck through twice, thrice, four times or five times. By these displacements, which result only in deforming the tube section between the tube-bottom and the sheet-metal bottom 61, it is possible to reduce the tube-bottom from radius R to radius $r$.

Figure 5:
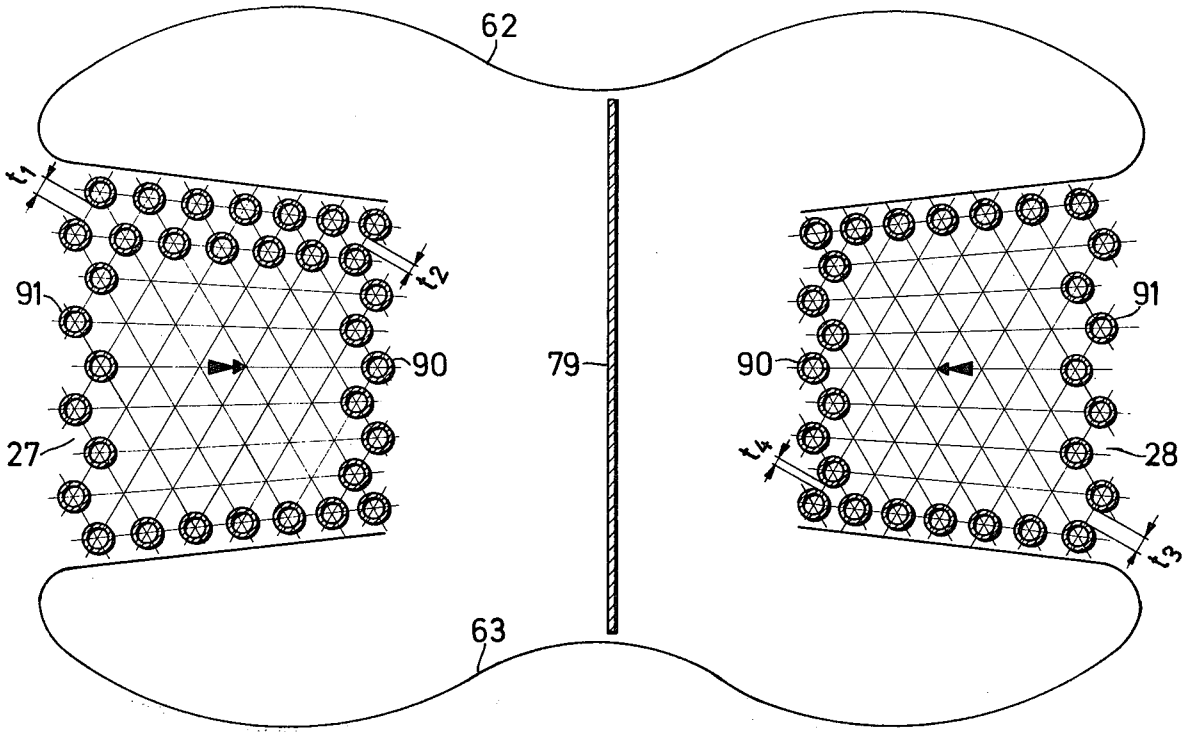
FIG. 5 illustrates, to a larger scale than FIG. 2, a modified form of construction of the reheater of the steam generator according to the invention.

With the group of U-shaped tubes 25 tube sequent rows of tubes set in the flow of heating gas are heated differently in the two leg portions 27, 28 because of the cooling down of the heating gas. At the rearmost row of tubes in the flow of gas, the temperature difference between the heating gas and the partly expanded steam is less than in the first flowed-over row. In order to remedy this unequal heating, the heat transfer operation is controlled. This is done in that the spacing between the tubes is continuously diminished in the direction of flow of the heating gas, as shown in the example of FIG. 5. With this example, the leg portions 27, 28 are set in a hexagonal pattern. The tube spacing $t_1$ of the leg portions 27 at the inflow of the gas decreases continuously to a value $t_2$ at the outflow of the gas. With the leg portion 28 there is a corresponding variation of the tube spacing from $t_3$ down to a value $t_4$. In addition, the spacing $t_3$ is less than $t_1$; and $t_4$ is less than $t_2$. This ensures that, for example in both leg portions of a U-tube 90 disposed at the gas outlet, the same quantity of heat will be absorbed as in the two leg portions of a U-tube 91 disposed at the gas inflow, because the smaller heating-gas/steam temperature difference at U-tube 90 is compensated by a greater heat-transfer coefficient. Because of the smaller average spacing of the leg portion 28 than that of the leg portion 27, the heating-gas flow at this leg portion 27 is cooled the same amount of temperature as the heating-gas flow at the leg portion 28, because the amount of heat taken from the last-named gas flow relates to a smaller gas flow. Because the quantity of gas flowing round the leg portion 27 is greater than that flowing round leg portion 28, it is advantageous to offset the partition 79 somewhat from the middle toward the leg portion 28.

Instead of a continuous diminution of ths spacing between the tubes in the leg portions, it is also possible to decrease them step by step.

For the purpose of transportation, the steam generator is taken apart into at least two parts, namely a first part consisting of the casing 60, the group of U-shaped tubes 25 and the tube-bottoms **8*b* and 9*b*, including the connectors 8*a* and 9*a*, and a second part consisting of the heat-transmitter 13 with the sheet-metal cylinders 31, 32, 44 and 46, together with the annular disks 45, 47, 38, and the connector 48. At the site of installation, the first-named part is installed in the space in the concrete enclosure 2 with the lining 4. The sheet-metal casing 60 is thus supported on the bottom 2', on which the tubes 25 of the reheater are supported, or are supported on the concrete enclosure 2. After this, the entire second part of the steam generator is set over the casting 60. In the first place, the tube-bottom 6*b*** is introduced into the steel lining 6 and the tube-bottom 7b is introduced into the steel lining 7. Then, the connector 48 is pushed over the connector 80 on the sheet-metal casing 60 until the ring 35 is seated on the intermediate flange 36.

When the entire second part with the tube groups 11 and 22 is too long for transportation, then it is possible to sever these tubes slightly below the annular disk 45, and to connect them individually with the heat-transfer tubes 12 at the installation site.

Figure 6:
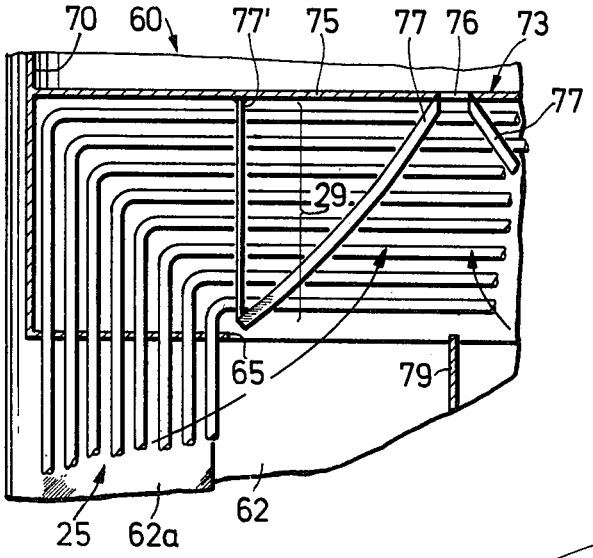
FIG. 6 illustrates, to a greater scale than FIG. 1, a further modified form of construction of the reheater according to the invention.

Referring to FIG. 6, instead of stagnating the heated gas flow at the cover 73 over the horizontal portions of the reheater, a rectangular opening 76 may be formed in the web 75 of the cover 73 which extends substantially across the width of the U-shaped tubes 25. The opening 76 ensures that a part of the heating gas flows through the region of the horizontal portion 29 of the U-shaped tubes 25. Because the opening 76 is smaller than the inside width between the leg portions 27, 28, the flow of the heating gas is greatly converged in the direction toward the opening 76. As a result, the speed of flow of the gas, and thus the transfer of heat from the gas to the portion 29 of the tubes increases upwardy. On the other hand, because of the converging course of the flow, the tube area subjected to the flow decreases from row to row of the tubes. By suitably choosing the size of the opening 76, the amount of heat transmitted in the region of the portion 29 to the individual rows of tubes may be made so that the different absorptions of heat in the leg portions 27, 28 is at least partly compensated. The transmitted amount of heat is proportional to the product $L \cdot \alpha \cdot \Delta t$, whereby $L$ designates the tube length subjected to the flow, $\alpha$ designates the heat-transfer coefficient; and $\Delta t$ designates the time.

In order to positively guide the heating gas in the region of the horizontal portion 29 of tubes, as shown by FIG. 6, slightly bent conductor rods 77 are disposed between the tubes. These rods 77 are secured at one side to the web sheet 75 at the opening 76, and are secured at the other side to vertical support-rods 77', which likewise extend between the tubes. The conductor rods 77 may be bent so that the heat transmitted per row of tubes for example runs linearly over the height.

The reheater with a sheet-metal casing is of substantially symmetrical construction. This results in a practically symmetrical distribution of the forces and thus in no resultants worth mentioning.

Heat insulation may also be provided at various places of the steam generator, e.g., on the side walls 62, 63 of the sheet-metal casing 60.

What is claimed is:

1. A gas heated steam generator comprising
means defining a cylindrical chamber having a bottom and an inlet for a flow of heated gas;
an evaporator disposed in said chamber for evaporating a flow of feed water;
means for feeding water to said evaporator;
a superheater connected to said evaporator within said chamber for heating the flow of evaporated feed water to steam, said superheater being mounted in communication with said bottom to deliver steam from said chamber;
a reheater within said chamber, said reheater including a group of U-shaped tubes having a pair of vertically disposed spaced apart leg portions, said leg portions being mounted in said bottom to receive and conduct steam from outside said chamber from one leg portion to the other leg portion;
a casing surrounding said group of U-shaped tubes, said casing having a pair of oppositely disposed openings communicating with said inlet; and
means directing the heated gas flows from said opening in two counterflows over each of said leg portions of said group of U-shaped tubes and subsequently over said superheater and said evaporator.

2. A steam generator as set forth in claim 1 wherein said means for delivering feed water includes supply lines within said chamber extending from said bottom to said evaporator and in communication with the exterior of said chamber.

3. A steam generator as set forth in claim 1 which further comprises exhaust lines within said chamber extending from said superheater to said bottom, said exhaust lines being in communication with the exterior of said chamber to deliver steam therefrom.

4. A steam generator as set forth in claim 1 which further comprises a cover within said casing disposed over the remaining portions of said U-shaped tubes relative to divert the flow of heated gas from said leg portions around said remaining portions and said cover, said cover being spaced from two sidewalls of said casing to permit the flow of the diverted gas around said cover.

5. A steam generator as set forth in claim 4 wherein said cover is U-shaped and is positioned over said remaining portions of said U-shaped tubes.

6. A steam generator as set forth in claim 1 wherein said casing has a pair of undulating side walls each having sequentially arranged convex, concave and convex portions parallel to said leg portions of said U-shaped tubes.

7. A steam generator as set forth in claim 1 which further comprises a gas outlet connection in said casing disposed symmetrically of said leg portions of said U-shaped tubes.

8. A steam generator as set forth in claim 1 wherein each leg portion of said group of U-shaped tubes has the tubes thereof disposed at a decreasing spacing relative to the flow of heated gas to obtain a uniform heating of said tubes.

9. A steam generator as set forth in claim 1 wherein said bottom has a square pattern of bores for receiving the tube ends of said group of U-shaped tubes.

10. A steam generator as set forth in claim 1 wherein said casing has a bottom sheet spaced from said chamber bottom and each said leg portion extends through said bottom sheet to said chamber bottom with the portions of said tubes in each leg portion being bent between said bottom sheet and said chamber bottom.

11. A steam generator as set forth in claim 10 wherein each leg portion has tubes disposed at a decreasing transverse spacing relative to the flow of heated gas.

12. A steam generator as set forth in claim 10 wherein each leg portion has tube disposed at a decreasing longitudinal spacing relative to the flow of heated gas.

13. A steam generator as set forth in claim 10 wherein the tubes in one of said leg portions are spaced apart at a greater spacing then the tubes of the other leg portion.

14. A gas heated steam generator comprising
a first part containing a group of U-shaped tubes defining reheater, a casing surrounding said group of U-shaped tubes and having a pair of oppositely disposed openings to receive heated gas, and a first tubular connector on said casing defining an outlet opening for the heated gas within said casing; and
a second part removably mounted on said first part, said second part including an evaporator, a superheater, and a second tubular connector mounted coaxially with said first connector to permit the heated gas to flow over said superheater and said evaporator.

* * * * *

UNITED STATES PATENT AND TRADEMARK OFFICE

CERTIFICATE OF CORRECTION

PATENT NO. : 4,047,506

DATED : September 13, 1977

INVENTOR(S) : Max Weber

It is certified that error appears in the above-identified patent and that said Letters Patent are hereby corrected as shown below:

Abstract, line 8 - after "direct" omit --,--

Col. 1, line 43, change "aa" to -- a --

Col. 2, line 34, after "e.g." omit --,--

Column 2, line 68, change "therminal" to -- terminal --

Col. 4, line 46, change "the" to -- The --

Col. 6, line 51, change "ths" to -- the --

Col. 6, line 67, change "casting" to -- casing --

Col. 7, line 22, change "upwardy" to --upwardly --

Col. 7, line 47, after "e.g." omit -- , --

Signed and Sealed this

Second Day of May 1978

[SEAL]

Attest:

RUTH C. MASON
Attesting Officer

LUTRELLE F. PARKER
Acting Commissioner of Patents and Trademarks